US008066580B2

(12) United States Patent
Conway

(10) Patent No.: US 8,066,580 B2
(45) Date of Patent: Nov. 29, 2011

(54) PUTT AND SWING TRAINING PLATE

(76) Inventor: John Conway, Freeville, NY (US)

( * ) Notice: Subject to any disclaimer, the term of this patent is extended or adjusted under 35 U.S.C. 154(b) by 0 days.

(21) Appl. No.: 12/948,133

(22) Filed: Nov. 17, 2010

(65) Prior Publication Data

US 2011/0224010 A1 Sep. 15, 2011

Related U.S. Application Data

(63) Continuation-in-part of application No. 12/723,947, filed on Mar. 15, 2010.

(60) Provisional application No. 61/172,367, filed on Apr. 24, 2009.

(51) Int. Cl.
*A63B 69/36* (2006.01)

(52) U.S. Cl. ..... 473/218; 473/257; 473/409

(58) Field of Classification Search ..... 473/218, 473/257, 265, 270–273, 278, 279
See application file for complete search history.

(56) References Cited

U.S. PATENT DOCUMENTS

| | | | | |
|---|---|---|---|---|
| 3,860,247 | A | 1/1975 | Taylor | |
| 3,868,116 | A | 2/1975 | Ford et al. | |
| 4,538,815 | A | 9/1985 | Poirier | |
| 5,246,234 | A * | 9/1993 | Zambelli | 473/272 |
| 5,478,081 | A | 12/1995 | Terry | |
| 6,949,029 | B1 | 9/2005 | Strande | |
| 2010/0273563 | A1 * | 10/2010 | Conway | 473/218 |

* cited by examiner

*Primary Examiner* — Nini Legesse
(74) *Attorney, Agent, or Firm* — Brown & Michaels, PC

(57) ABSTRACT

A golf training plate including a body rectangular in shape comprising a top surface, a left side, a right side, a forward side and a rear side having two foot placement cutouts extending from the rear side towards the forward side and an alignment arm in the shape of an "L" comprising a short portion adjacent the right side of the body and a long portion, substantially parallel to the forward side of the body defining a training space for placement of a ball. The body and the alignment arm each have a series of ball alignment lines to aid in placement of the ball relative to the foot placement cutouts.

4 Claims, 13 Drawing Sheets

Fig. 10

270

| Shot Number | Left Foot Position (272) | Right Foot Position (274) | Distance of ball from feet (276) | Left Toe Alignment (278) | Right Toe Alignment (280) | Ball Placement (282) | Target? (284) |
|---|---|---|---|---|---|---|---|
| 1 | 11 | 12 | 15 | 7 | 7 | 3 | Y |
| 2 | 10 | 12 | 16 | 7 | 7 | 2 | N |
| 3 | 9 | 12 | 16 | 6 | 6 | 3 | N |
| 4 | 10 | 12 | 16 | 6 | 6 | 2 | N |
| 5 | 11 | 12 | 16 | 7 | 7 | 2 | Y |
| 6 | | | | | | | |
| 7 | | | | | | | |
| 8 | | | | | | | |
| 9 | | | | | | | |

Fig. 11

286 278 272 280 274 282 276 288

Caddie Master Sheet

Ball & Body Position

| Club | Left Toe Alignment | Left Foot Position | Right Toe Alignment | Right Foot Position | Ball Placement | Distance of ball from feet | Caddie Notes |
|---|---|---|---|---|---|---|---|
| Driver | 7 | 11 | 7 | 12 | 3 | 15 | |
| 3 Wood | | | | | | | |
| 5 Wood | | | | | | | |
| 3 Iron | | | | | | | |
| 5 Iron | | | | | | | |
| 6 Iron | | | | | | | |
| 7 Iron | | | | | | | |
| 8 Iron | | | | | | | |
| 9 Iron | | | | | | | |
| Pitching Wedge | | | | | | | |
| Sand Wedge | | | | | | | |
| Lob Wedge | | | | | | | |
| Putter | | | | | | | |
| | | | | | | | |
| | | | | | | | |
| | | | | | | | |

PUTT AND SWING TRAINING PLATE

REFERENCE TO RELATED APPLICATIONS

This application is a continuation-in-part of application Ser. No. 12/723,947, filed Mar. 15, 2010, and entitled "PUTT AND SWING TRAINING PLATE". This application also claims one or more inventions which were disclosed in Provisional Application No. 61/172,367, filed Apr. 24, 2009, entitled "PUTT AND SWING TRAINING PLATE". The benefit under 35 USC §119(e) of the United States provisional application is hereby claimed, and both of the aforementioned applications are hereby incorporated herein by reference.

BACKGROUND OF THE INVENTION

1. Field of the Invention

The invention pertains to the field of golf. More particularly, the invention pertains to training aids for golf.

2. Description of Related Art

Golf has become a popular sport and many people take lessons from instructors in order to improve their golfing skills. One area that is always under improvement is the golf swing. In some cases, players set up tees in a few places to help them make their swing more consistent, but even with an instructor, an individual's golf swing is difficult to consistently monitor and alter as necessary to help them achieve a consistent swing that enables the user to accurately get the ball to travel to the hole.

SUMMARY OF THE INVENTION

A golf training plate of a first embodiment includes a body rectangular in shape with a top surface, a left side, a right side, a forward side and a rear side having two foot placement cutouts extending from the rear side towards the forward side. An alignment arm in the shape of an "L" is present adjacent the body. The alignment arm has a short portion adjacent the right side of the body and a long portion, substantially parallel to the forward side of the body defining a training space for placement of a ball. The body and the alignment arm each have a series of ball alignment lines to aid in placement of the ball relative to the foot placement cutouts.

In one embodiment, swing alignment tabs are present on the short portion of the L-shaped alignment arm.

In another embodiment, the golf training plate includes a body rectangular in shape with a top surface, a left side, a right side, a forward side and a rear side having two foot placement cutouts extending from the rear side towards the forward side. An alignment arm in the shape of an "L" is present adjacent the body. The alignment arm has a short portion adjacent the right side of the body and a long portion, substantially parallel to the forward side of the body defining a training space for placement of a ball. The body has a first set of foot placement lines adjacent the foot placement cutouts and a second set of foot placement lines located around the portion of the foot placement cutouts closest to the forward side of the body. The body also has a series of parallel ball alignment lines spaced apart a distance between the foot placement cutouts with at least one of the lines located along a center line between the left side and right side of the body, perpendicular to the forward side of the body. A series of parallel ball alignment lines corresponding to different types of golf clubs are also present on the long portion of the alignment arm with at least one of the lines located along a center line. The short portion of the alignment arm has a series of ball distance placement lines.

BRIEF DESCRIPTION OF THE DRAWING

FIG. 10 shows an example of a training sheet used with the training plate of the present invention.

FIG. 11 shows an example of a caddie master sheet used with the training plate of the of the present invention.

DETAILED DESCRIPTION OF THE INVENTION

Figure 1:
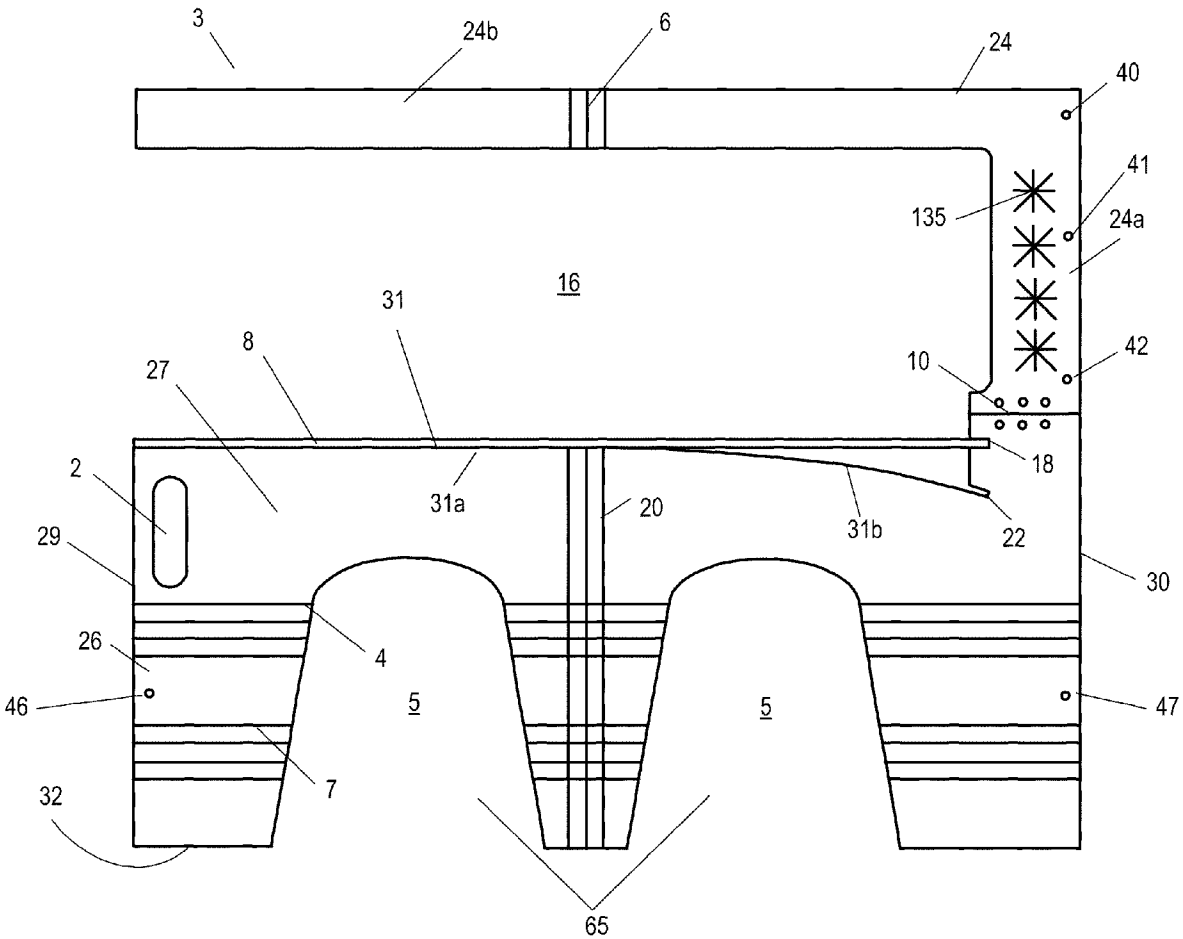
FIG. 1 shows a top view of the training plate in a first training position.

FIGS. 1-4 show a training plate 3 of a first embodiment for designating proper setup positioning for swinging the golf club and for monitoring the club head take away and travel of the club head prior to impact with the ball. The training plate 3 of the first embodiment may be used for training on putting shots, shots being less than ten feet away from the tee, including but not limited to pendulum putting shots and natural arch putting shots, or for iron shots, shots being greater than ten feet away from the tee.

The training plate 3 includes a generally rectangular body 26 and an L-shaped alignment arm 24. The body 26 has a top surface 27, a bottom surface (not shown), a left side 29, a right side 30, a forward side 31, and a rear side 32. Holes 46 and 47 are present on the body to secure the body to the ground using golf tees or stakes if necessary. The forward side 31 of the body 26 has a straight portion 31*a* and a portion 31*b* that is radiused back in order to establish a curved portion 31*b*. A straight arm 8 with a length is firmly attached to the forward side 31 of the training plate and has a flexible portion 8*a* at one end which fits into slots 18, 22 on the right side 30 of the body 26. If the flexible portion 8*a* of the arm 8 is received by slot 18, the arm 8 is straight from the left side 29 of the body to the right side 30 of the body 26, substantially parallel to an alignment arm 24 and does not follow the curved portion 31*b* of the forward side 31 of the body 26. If the flexible portion 8*a* of the arm 8 is received by slot 22, the flexible arm 8 will follow the curved portion 31*b* of the forward side 31 of the body 26.

Figure 7:
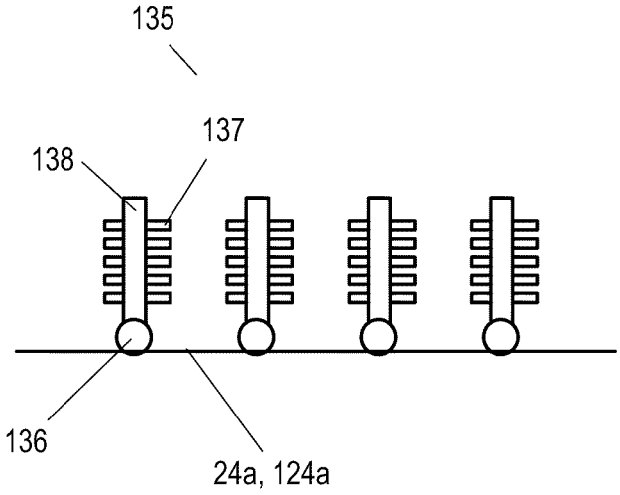
FIG. 7 shows a side view of tabs.

The alignment arm 24 is rotatably connected to the body 26, preferably through a hinge 10. The alignment arm 24 is preferably L-shaped having a short portion 24*a* and a long portion 24*b*, with the longer portion 24*b* of the "L" is substantially parallel to the forward side 31 of the body 26. A series of holes 40, 41, and 42 are present along the short portion 24*a* of the alignment arm 24 and may used with golf tees or some other type of stake to secure the alignment arm to the ground. Preferably along the short portion 24*a* of the alignment arm 24 are a series of swing alignment tabs 135 that are each individually pivotably connected to the arm 24*a*. A side view of the swing alignment tabs 135 is shown in FIG. 7. The swing alignment tabs 135 are preferably comprised of a rod 138 pivotably attached to a pivot 136 with a series of tabs 137. The tabs 137 may also be feathers, bristles, brushes or any other material that may be knocked down by the golf club head without injuring the head of the club. The placement and the fact that the series of swing alignment tabs 135 can easily be knocked down indicates where the golf club head is on the swing take-away and the location and travel of the club head before impacting the ball. The tabs 135 may be reset to continue practicing and learn the correct inside swing path of the golf club head.

Figure 2:
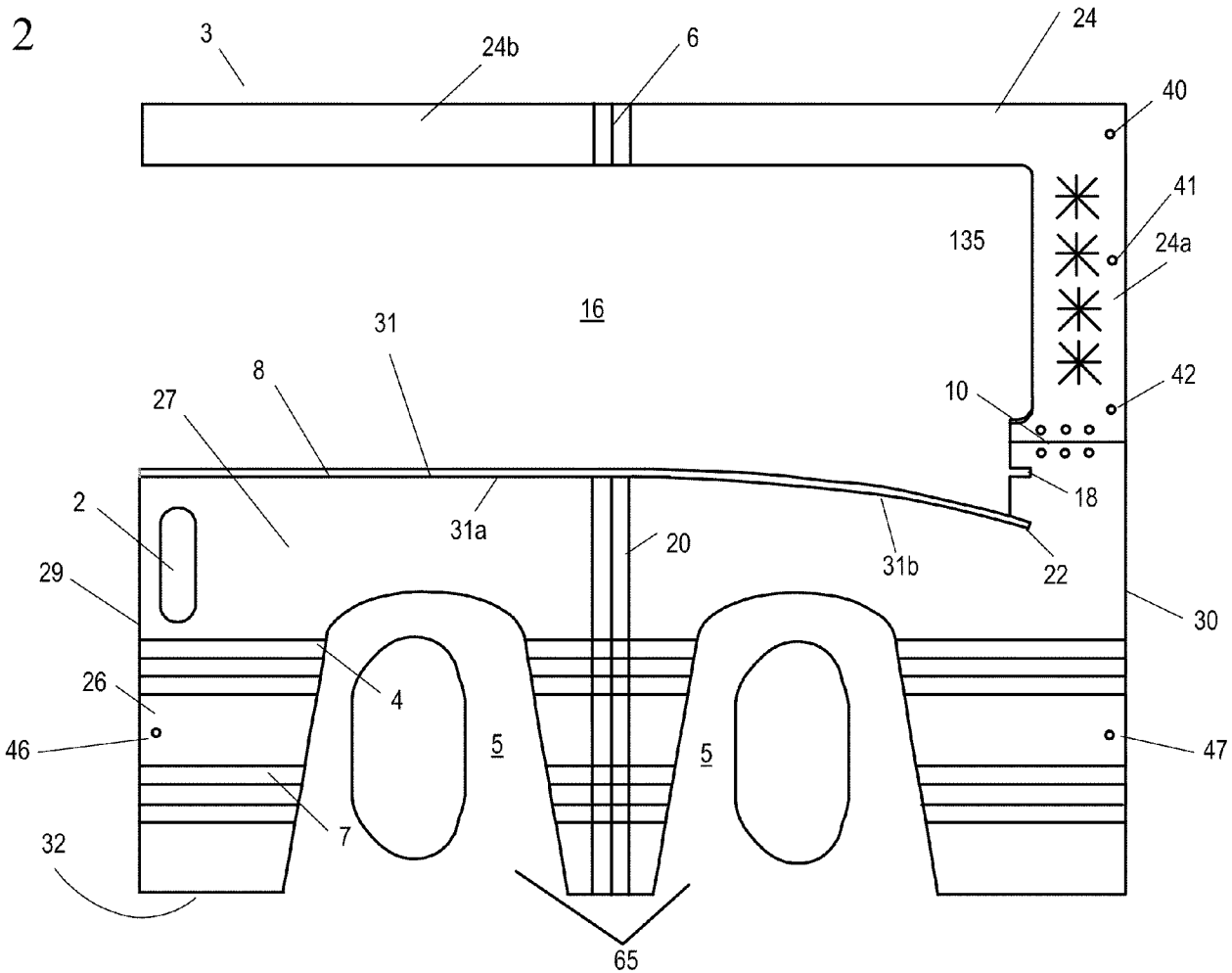
FIG. 2 shows a top view of the training plate in a second training position.
Figure 3:
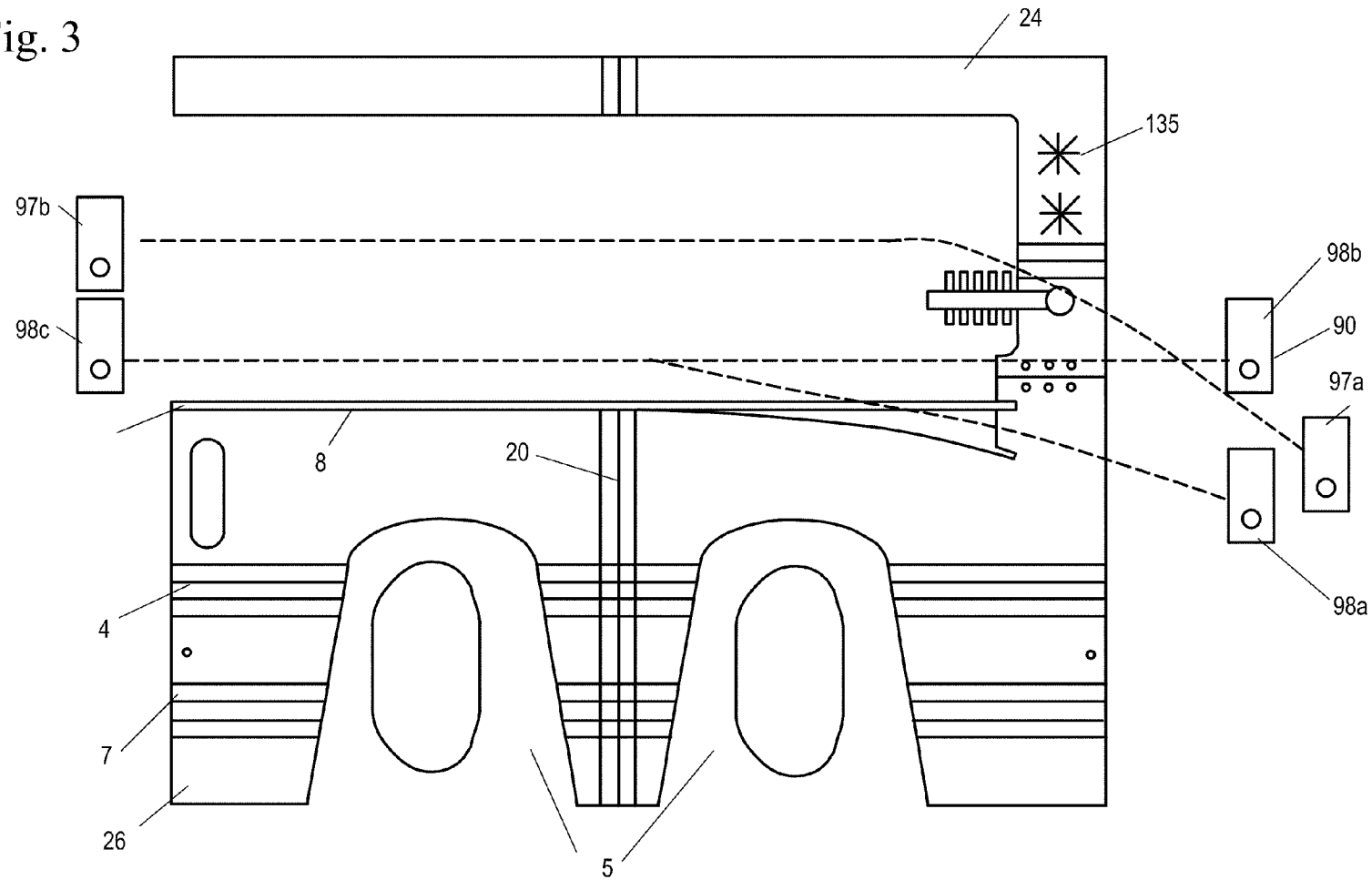
FIG. 3 shows a schematic of the training plate of the first embodiment used by a golfer.
Figure 4:
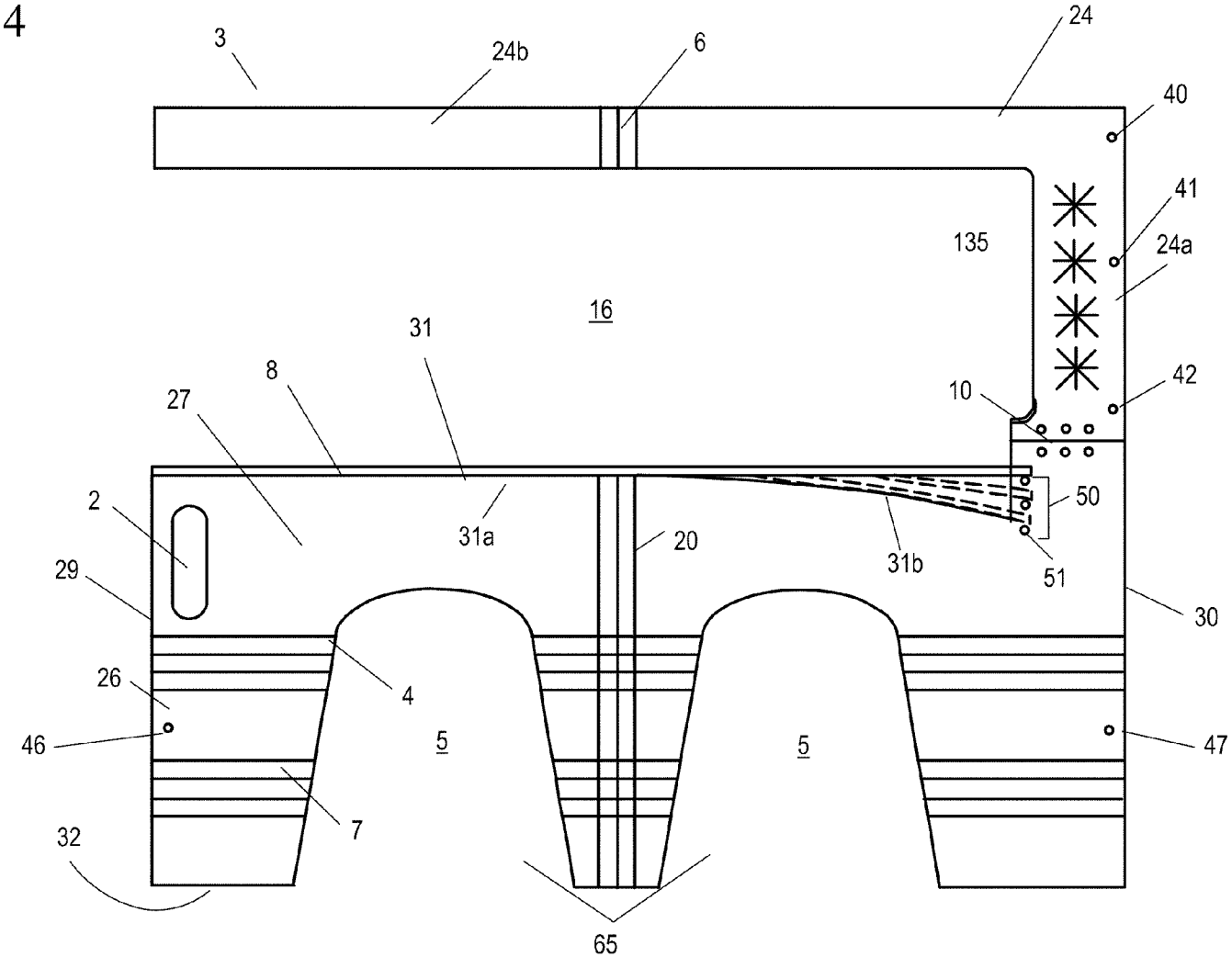
FIG. 4 shows a top view of a second embodiment of the training plate.

When the training plate 3 is laid flat and in training position, as shown in FIGS. 2-4, a training space 16 is defined between the long portion 24*b* of the alignment arm 24, the short portion 24*a* of the alignment arm 24, the forward side 31 of the body 26, and a flexible arm 8. When the training plate is used by a user, at least one golf ball (not shown) is placed within the training space 16.

The body 26 defines a foot placement space 65 which is preferably divided into two foot placement cutouts 5 that are widest at the rear side 32 of the body 26 and become narrower as the cutouts 5 approach the forward side 31 of the body 26. The top surface 27 of the body 26 preferably has a series of foot placement lines 4, 7 adjacent to the foot placement cutouts 5 to aid the user with proper foot placement that run parallel to the alignment arm 24. A first set of foot placement lines 4 are located where the toes of the users would be when their feet are in the foot placement cutouts 5 and the second set of foot placement lines 7 are located where the heel of the users would be present when their feet are in the foot placement cutouts 5.

The top surface 27 of the body 26 also includes ball alignment lines 20 which are comprised of a series of parallel lines that are spaced apart a distance from each other, between the two foot placement cutouts 5, with at least one of the lines located along a center line that is located between the left side 29 and right side 30 of the body 26 and perpendicular to the long portion 24*b* of the alignment arm 24. The lines 20 preferably extend from the rear side 32 of the body 26 to the forward surface 31 of the body 26. The parallel lines 20 are preferably spaced apart from each other a distance of ⅝". The long portion 24*b* of the alignment arm 24 has corresponding ball alignment lines 6 which are comprised of a series of parallel lines that are aligned with the series of parallel lines 20 on the top surface 27 of the body 26, where at least one of the lines is located along a center line of the long portion 24*b* of the L-shaped alignment arm 24. The center line on the top surface 27 of the body 26 and the center line on the long portion 24*b* of the alignment arm 24 are used for alignment and placement of the golf ball within the training space 16.

A ball may be aligned with the training space 16, using center lines, the center line of the ball alignment lines 20 on the body 26 perpendicular to the long portion 24*b* of the alignment arm 24 and the center line of the ball alignment lines 6 on the long portion 24*b* of the alignment arm 24.

The training plate may fold up into a travel position and can be unfolded back into a training position. When the training plate is folded, alignment arm 24 is rotated on the hinge 10 and the short portion 24*a* of the alignment arm 24 lays adjacent to the end of the flexible arm 8 and the long portion 24*b* of the alignment arm 24 lays across the rear side 32 of the body 26. The alignment arm 24 is secured to the body by hook-and-loop fastener or Velcro®. A handle 2 is preferably present near the left side 29 of the body 26 and is used to easily carry the folded training plate.

To use the training plate for natural arch putting shots of ten to forty feet away from the tee, a user places the training plate a specific distance away from the hole or other chosen marker. The user may or may not use a tee or other stake to secure the training plate to the ground using holes 40, 41, 42, 46, and 47. A user then steps into the foot placement cutouts 5 and aligns their toes with one of the lines in the first set of foot placement lines 4 and their heels with one of the lines in the second set of foot placement lines 7. Then the user aligns a golf ball 80 in the training space 16 created between the long portion 24*b* of the alignment arm 24, the short portion 24*a* of the alignment arm 24, the forward side 31 of the body 26, and the flexible arm 8 with the a center line of the ball alignment lines 6 of long portion 24*b* of the alignment arm 24, and a center line of the parallel lines 20 on the top surface of the body 26. The flexible arm 8 is moved to a position, (if it is not already in position), where the end of the flexible arm 8 is received within slot 22. By having the end of the flexible arm 8 received by the second slot 22 on the body 26, the proper body, arm and radius motion of the user can occur. Then, the user hits the ball towards the hole or other marker chosen. The correct pathway of the club head 90 is shown by dashed line connecting golf head 98*a* to 98*c* in FIG. 3. If the club head 90 hits the training plate or during the putt swing the golf club head 90 is not parallel to the straight arm 8 after hitting the ball 80, the user may change the feet location, ball location, take away path, or swing path before impact to obtain the correct pathway of the club head.

To use the training plate for pendulum putting strokes to a chosen marker or hole ten feet of less away from the tee, a user places the training plate a specific distance away from the hole or other chosen marker. The user may or may not use a tee or other stake to secure the training plate to the ground using holes 40, 41, 42, 46, and 47. A user then steps into the foot placement cutouts 5 and aligns their toes with one of the lines in the first set of foot placement lines 4 and their heels with one of the lines in the second set of foot placement lines 7. Then the user aligns a golf ball 80 in the training space 16 created between the long portion 24*b* of the alignment arm 24, the short portion 24*a* of the alignment arm 24, the forward side 31 of the body 26, and the flexible arm 8 with the center line of the ball alignment lines 6 of long portion 24*b* of the alignment arm 24, and a center line of the parallel lines 20 on the top surface of the body 26. The flexible arm 8 is moved to a position, (if it is not already in position), where the end of the flexible arm 8 is received within slot 18 and the arm is substantially parallel to the long portion 24*b* of the alignment arm 24. By having the end of the flexible arm 8 received by the first slot 18 on the body 26, the proper body, arm and motion of the user can occur. Then, the user hits the ball towards the hole or other marker chosen. The correct pathway of the club head 90 is shown by dashed line connecting golf head 98*b* to 98*c* in FIG. 3. If the club head 90 hits the training plate or the during the putt swing the golf club head 90 is not parallel to the straight arm 8 after hitting the ball 80, the user may change the feet location, ball location, take away path, or swing path before impact to obtain the correct pathway of the club head.

To use the training plate for iron shots to a chosen marker or hole greater than 40 feet away from the tee, a user places the training plate a specific distance away from the hole or other chosen marker. The user may or may not use a tee or other stake to secure the training plate to the ground using holes 40, 41, 42, 46, and 47. A user then steps into the foot placement cutouts 5 and aligns their toes with one of the lines in the first set of foot placement lines 4 and their heels with one of the lines in the second set of foot placement lines 7. Then the user aligns a golf ball in the training space 16 created between the long portion 24*b* of the alignment arm 24, the short portion 24*a* of the alignment arm 24, the forward side 31 of the body 26, and the flexible arm 8 with a center lines of the ball alignment lines 6 of long portion 24*b* of the alignment arm 24, and a center line of the parallel lines 20 on the top surface of the body 26. A series of swing alignment tabs 135 are rotated to an upright position on the short portion 24*a* of the alignment arm 24. The flexible arm 8 is moved to a position, (if it is not already in position), where the end of the flexible arm 8 is received within slot 18 and the arm is substantially parallel to the long portion 24*b* of the alignment arm 24. By having the end of the flexible arm 8 received by the first slot 18 on the body 26, the proper body, arm and motion of the user can occur. Then, the user hits the ball towards the hole or other marker chosen. The correct pathway of the club head 90 is shown by dashed line connecting golf head 97*a* to 97*b* in FIG. 3. Depending on which of the tabs 135 are knocked down due to impact of the club head, the user may adjust their feet position or ball position to adjust the pathway of their swing to obtain the correct pathway of the club head.

FIG. 4 shows a training plate of a second embodiment. Instead of cutting holes or slots 18, 22 in the body 26 to receive the flexible portion 8*a* of the arm 8, a series of holes 50 a predetermined distance apart may be present for receiving a pin 51, and the flexible portion 8*a* of the arm 8 is flexed behind the pin 51 to change the radius of the arc of the shot a user should follow.

Additionally the arm 8 does not have to be firmly attached to the straight portion 31*a* of the forward surface 31 of the body 26 and may instead be pinned into place along the straight portion 31*a* of the forward surface of the body 26.

FIGS. 5-8 show a training plate 103 of a third embodiment that may be used for all clubs including drivers and short irons for designating proper alignment, body position, and swing path of the golf club. The training plate 103 of the third embodiment shows alignment and references the ball, feet and body position for each club and each shot taken. Shots preferably range from 50 to 300 yards.

The training plate 103 includes a generally rectangular body 126 and an L-shaped alignment arm 124. The body 126 has a top surface 127, a bottom surface (not shown), a left side 129, a right side 130, a forward side 131, and a rear side 132. Holes 146 and 147 are present on the body to secure the body 126 to the ground using golf tees or stakes if necessary. A handle 102 is preferably present near the left side 129 of the body 126 and is used to easily carry the training plate.

The alignment arm 124 is preferably slidably connected to the side 130 of the body 126 preferably through a tongue and groove arrangement 145, although the alignment arm may also just be placed next to the left side 129 or right side 130 of the rectangular body 126. The alignment arm 124 is preferably L-shaped having a short portion 124*a* and a long portion 124*b*, with the longer portion 124*b* of the "L" is substantially parallel to the forward side 131 of the body 126. A series of holes 140, 141, and 142 are present along the short portion 124*a* of the alignment arm 124 and may used with golf tees or some other type of stake to secure the alignment arm to the ground. Preferably along the short portion 124*a* of the alignment arm 124 are a series of tabs 135 that are each individually pivotably connected to the arm 124*a*. A side view of the swing alignment tabs 135 is shown in FIG. 7. The swing alignment tabs 135 are preferably comprised of a rod 138 pivotably attached to a pivot 136 with a series of tabs 137. The tabs 137 may also be feathers, bristles, brushes or any other material that may be knocked down by the golf club head without injuring the head of the club. The placement and the fact that the series of swing alignment tabs 135 can easily be knocked down indicates where the golf club head is on the swing take-away and the location and travel of the club head before impacting the ball. The tabs 135 may be reset to continue practicing and learn the correct inside swing path of the golf club head.

Figure 5:
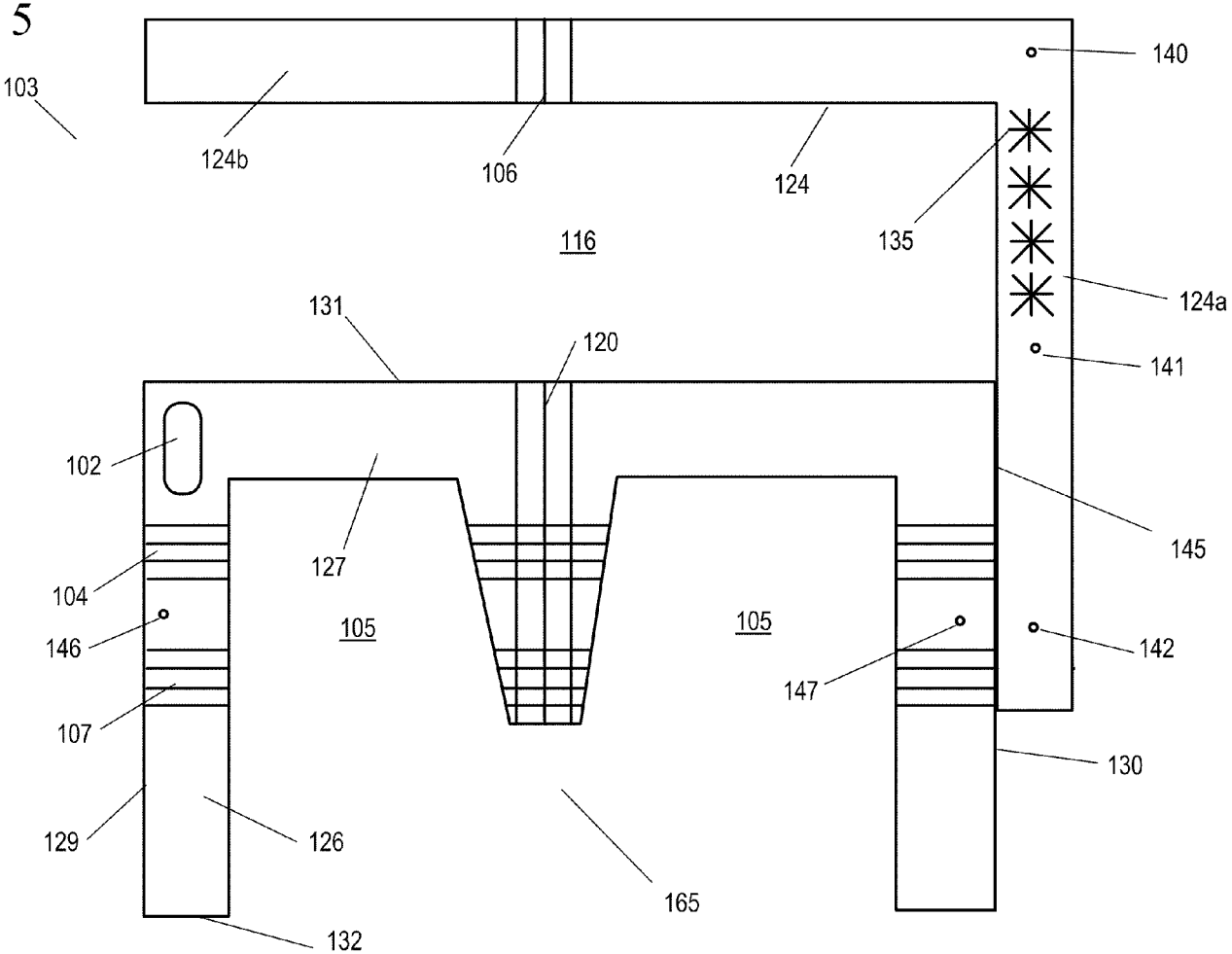
FIG. 5 shows a top view of a training plate of a third embodiment.
Figure 6:
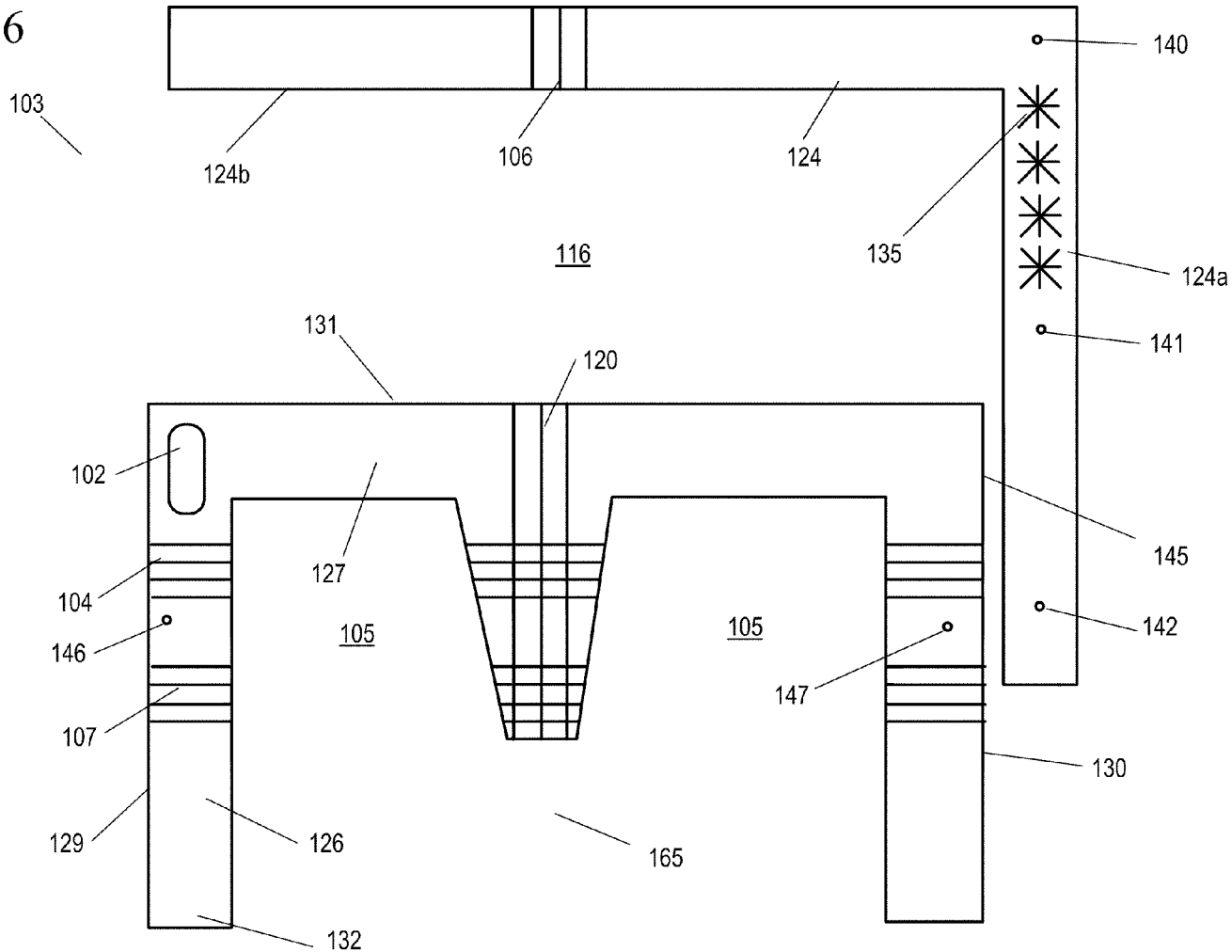
FIG. 6 shows an alternate top view of a training plate of a third embodiment.
Figure 8:
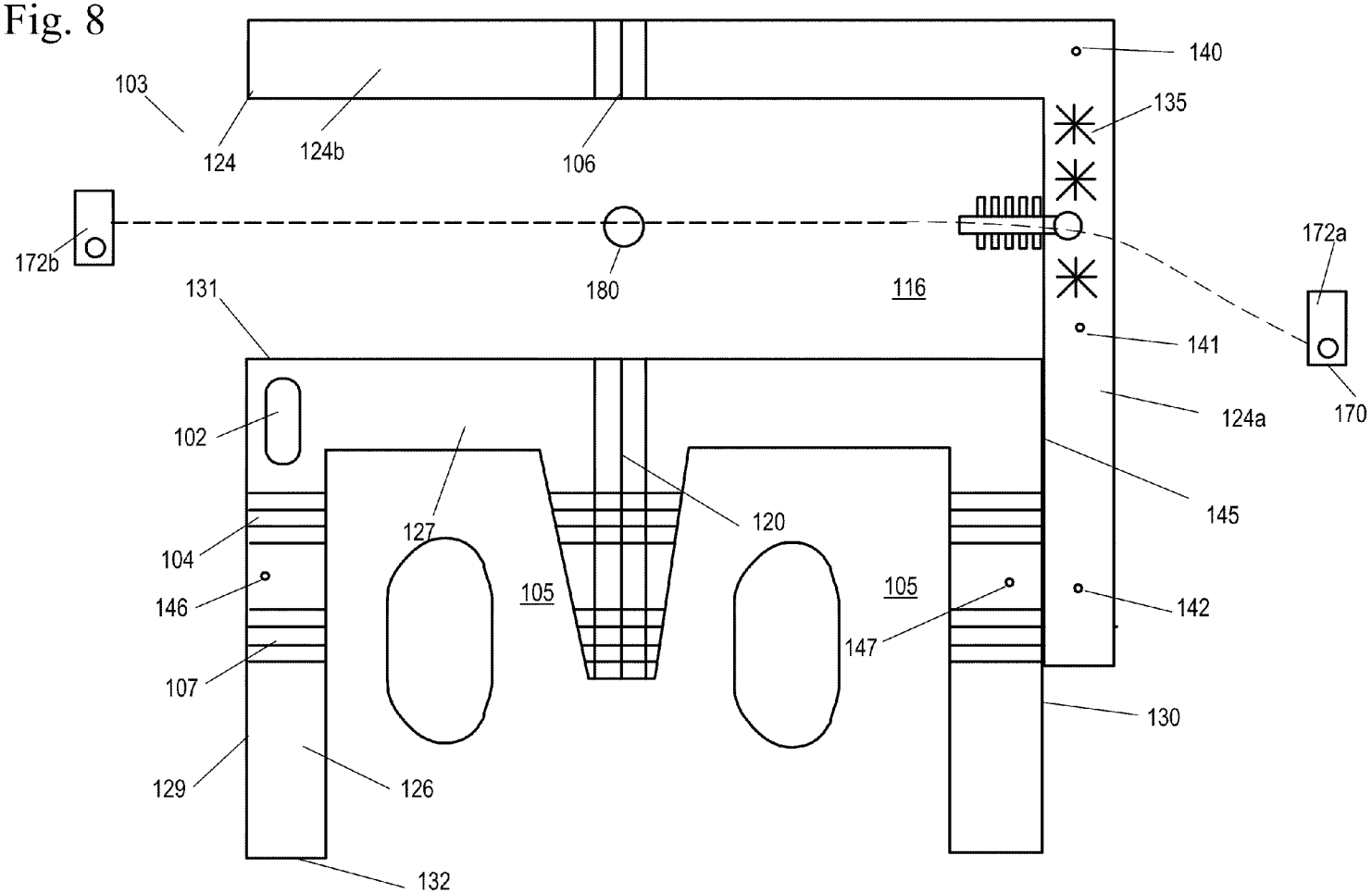
FIG. 8 shows a schematic of the training plate of the third embodiment used by a golfer.

When the training plate is laid flat and in training position, as shown in FIGS. 5-6 and 8, a training space 116 is defined between the long portion 124*b* of the alignment arm 124, the short portion 124*a* of the alignment arm 124, and the forward side 131 of the body 126. When the training plate is used by a user, at least one golf ball (not shown) is placed within the training space 116.

The body 126 defines a foot placement space 165 which is preferably further divided into two foot placement cutouts 105 that are widest at the rear side 132 of the body 126 and become narrower as the cutouts 105 approach the forward side 131 of the body 126. The top surface 127 of the body 126 preferably has a series of foot placement lines 104, 107 adjacent to the foot placement cutouts 105 to aid the user with proper foot placement that runs parallel to the alignment arm 124. A first set of foot placement lines 104 are located where the toes of the users would be when their feet are in the foot placement cutouts 105 and the second set of foot placement lines 107 are located where the heel of the users would be present when their feet are in the foot placement cutouts 105.

The top surface 127 of the body 126 also includes ball alignment lines 120 which are comprised of a series of parallel lines that are spaced apart a distance from each other, between the two foot placement cutouts 105, with at least one of the lines locating along a center line that is located between the left side 129 and right side 130 of the body 126 and perpendicular to the long portion 124*b* of the alignment arm 124. The lines 120 preferably extend from the rear side 132 of the body 126 to the forward side 131 of the body 126.

The parallel lines 120 are preferably spaced apart from each other a distance of ⅝". The long portion 124*b* of the alignment arm 124 has corresponding ball alignment lines 106 which are comprised of a series of parallel lines that are aligned with the series of parallel lines 120 on the top surface 127 of the body 126, where at least one of the lines is located along a center line of the long portion 124*b* of the L-shaped alignment arm 124. The center line on the top surface 127 of the body 126 and the center line on the long portion 124*b* of the alignment arm 124 are used for alignment and placement of the golf ball within the training space 116.

A ball may be aligned with the training space 116, using center lines, a center line of the parallel lines on the top surface 127 of the body, and a center line of the ball alignment lines 106 on the long portion 124*b* of the alignment arm 124.

The training plate 103 of the third embodiment may be used without the tabs 135 to correct a user's swing for all clubs including drivers and short irons for designating proper alignment, body position, and swing path of the golf club. To correct a user's swing, a user hits at least three shots to a target of choice which is preferably approximately 150 yards away. Then, the user or another individual marks the position of the user's feet and ball. Then, the training plate 103 is placed in position based on the markers for the user's feet and where the ball was. The placement of the training plate 103 relative to the where the user's feet and ball were when the shots towards the target were taken provides the relationship of where the ball was, the user's foot placement relative to the hole and where the arc of the user's swing had to come through. Based on the final resting position of the ball from the three shots relative to the target of choice, the ball may be moved left or right and the feet may be adjusted to turn the golfer's body and adjust the direction of the ball.

The training plate of the third embodiment may also be used with the tabs 135 to correct a user's swing for all clubs including drivers and short irons for designating proper alignment, body position, and swing path of the golf club. To correct a user's swing, a user places the training plate 103 a specific distance away from the hole or other chosen marker. The user may or may not use a tee or other stake to secure the training plate to the ground using holes 140, 141, 142, 146, and 147. A user then steps into the foot placement cutouts 105 and aligns their toes with one of the lines in the first set of foot placement lines 104 and their heels with one of the lines in the second set of foot placement lines 107. Then the user aligns a golf ball 180 in the training space 116 created between the long portion 124*b* of the alignment arm 124, the short portion 124*a* of the alignment arm 124, and the forward side 131 of the body 126. A series of swing alignment tabs 135 are rotated to an upright position on the short portion 124*a* of the alignment arm 124. Then, the user hits the ball towards the hole or other marker chosen. The correct pathway of the club head 170 is shown by dashed line connecting golf head 172*a* to 172*b* in FIG. 8. Depending on which of the tabs 135 are knocked down due to impact of the club head, the user may adjust their feet position or ball position to adjust the pathway of their swing.

Figure 9:
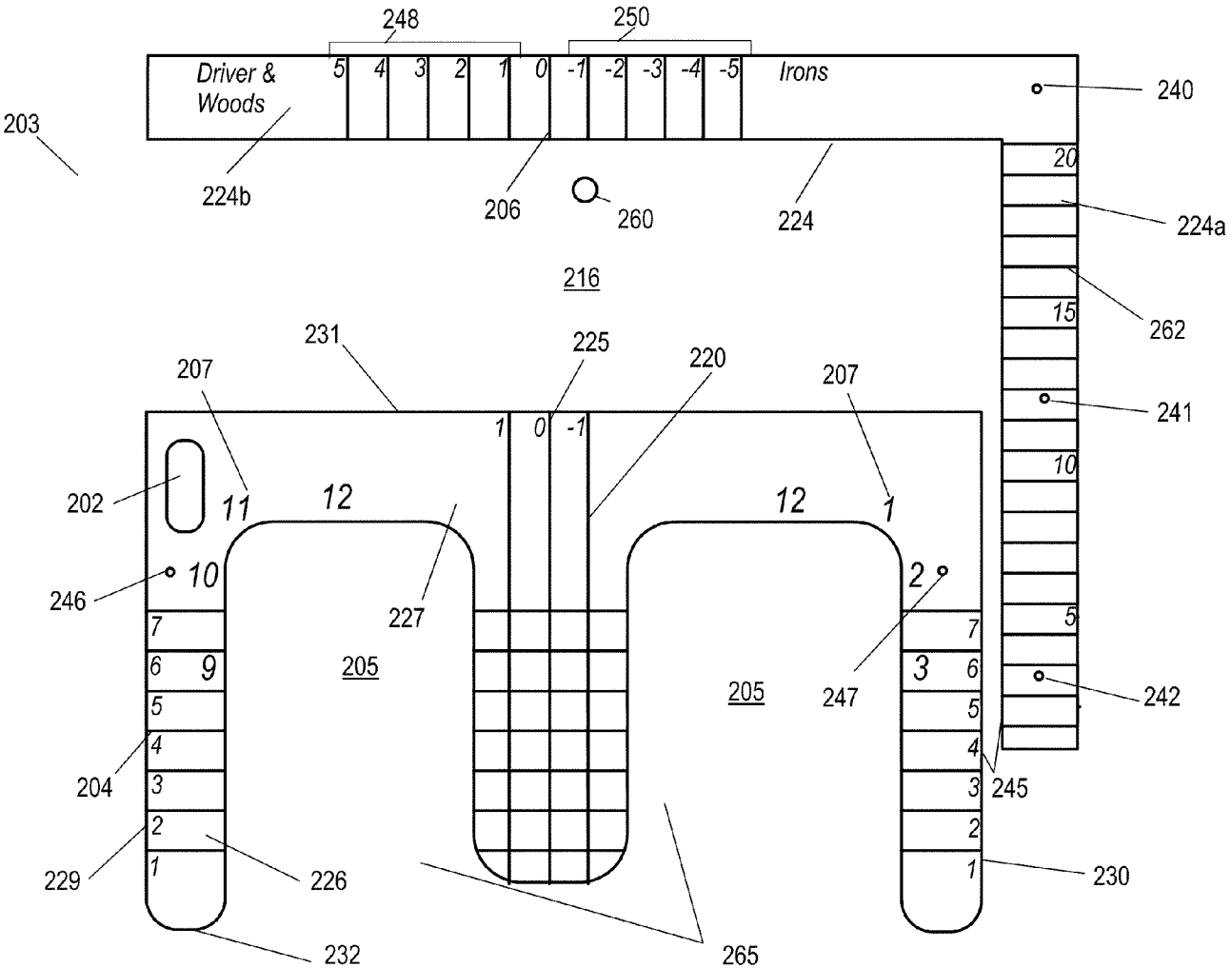
FIG. 9 shows a top view of a fourth embodiment of the training plate.

FIG. 9 shows a training plate 203 of a fourth embodiment that may be used for all clubs including drivers and short irons for designating proper alignment, body position, and swing path of the golf club. The training plate 203 of the fourth embodiment shows alignment and references for the ball, feet and body position for each club and each shot taken. Shots preferably range from 50 to 300 yards.

The training plate 203 includes a generally rectangular body 226 and an L-shaped alignment arm 224. The body 226 has a top surface 227, a bottom surface (not shown), a left side 229, a right side 230, a forward side 231, and a rear side 232. Holes 246 and 247 may be present on the body to secure the body 226 to the ground using golf tees or stakes if desired. A handle 202 may be present near the left side 229 of the body 226 and is used to easily carry the training plate.

The alignment arm 224 is preferably slidably connected to the side 230 of the body 226, preferably through a tongue and groove arrangement 245, although the alignment arm may also just be placed next to the left side 229 or right side 230 of the rectangular body 226. The alignment arm 224 is preferably L-shaped, having a short portion 224*a* and a long portion 224*b*, with the longer portion 224*b* of the "L" being substantially parallel to the forward side 231 of the body 226. A series of holes 240, 241, and 242 are present along the short portion 224*a* of the alignment arm 224 and may used with golf tees or some other type of stake to secure the alignment arm to the ground.

When the training plate is laid flat and in training position, as shown in FIG. 9, a training space 216 is defined between the long portion 224*b* of the alignment arm 224, the short portion 224*a* of the alignment arm 224, and the forward side 231 of the body 226. When the training plate is used by a user, at least one golf ball 260 is placed within the training space 216.

The body 226 defines a foot placement space 265 which is preferably further divided into two foot placement cutouts 205 that extend from the rear side 232 of the body and approach the forward side 231 of the body 226. The top surface 227 of the body 226 preferably has a series of foot placement lines 204, 207 adjacent to the foot placement cutouts 205 to aid the user with proper feet placement. The first set of numbered foot placement lines 204 run parallel to the short portion 224*a* of the alignment arm 224 and in this example are numbered 1 to 7. The first set of foot placement lines 204 indicate where the toes of the users would be when their feet are in the foot placement cutouts 205. The second set of foot placement lines 207 are present around the foot placement cutouts 205 and indicate the angle in which the toe of the user would be pointing. In this example, the numbers of the second set of foot placement 207 lines are 9 to 12 and 12 to 3 and preferably correspond to positions on a clock.

The top surface 227 of the body 226 also includes ball alignment lines 220 which are comprised of a series of parallel lines that are spaced apart a distance from each other, between the two foot placement cutouts 205, with at least one of the lines locating along a center line 225 that is located between the left side 229 and right side 230 of the body 226 and perpendicular to the long portion 224*b* of the alignment arm 224. The lines 220, 225 preferably extend from the rear side 232 of the body 226 to the forward side 231 of the body 226.

The long portion 224*b* of the alignment arm 224 has ball alignment lines 248, 250 that are specific to the type of club being used to take the shot. The ball alignment lines 248, 250 are comprised of a series of parallel lines in which at least two are aligned with the series of parallel lines 220 on the top surface 227 of the body 226 and where at least one of the lines 206 is located along a center line 225 of the long portion 224*b* of the L-shaped alignment arm 224. The ball alignment lines 248 present on the long portion 224*b* of the L-shaped alignment arm 224 are indicated by 1 to 5 and are for ball placement within the training space 216 for using drivers and woods. The center line 206 on the long portion 224*b* of the alignment arm 224 is indicated by the number 0. The ball alignment lines 250 present on the long portion 224*b* of the L-shaped alignment arm 224 are indicated by −1 to −5 and are for ball placement within the training space 216 for irons.

The short portion 224*a* of the L-shaped alignment arm 224 has ball distance placement lines 262 that are preferably numbered 1 to 20 indicating the number of inches of the back of the feet to the ball placed within the training space 216. It should be noted that FIG. 9 only shows numbers 5, 10, 15, and 20 to keep the figure clear.

The training plate 203 of the fourth embodiment may be used to correct a user's swing for all clubs including woods and drivers and irons for designating proper alignment, body position, and swing path of the golf club. To correct a user's swing, a user places the training plate 203 a specific distance away from the hole, target, or other chosen marker. The user may or may not use a tee or other stake to secure the training plate to the ground using holes 240, 241, 242, 246, 247. A user than steps into the foot placement cutouts 205 and aligns their toes with the first set of foot placement lines 204 and adjusts the angle of their feet with the second set of foot placement lines 207. Then the user aligns the golf ball 260 in the training space 216 created between the long portion 224*b* of the alignment arm 224, the short portion 224*a* of the alignment arm 224, and the forward side 231 of the body. The user hits at least three shots to a target of choice which is preferably approximately 150 yards away. For each shot hit by the user, the user or another individual marks or keeps track of the left and right foot position, distance of the ball from the feet, left and right toe alignment, ball placement, and whether the shot resulted in being near the target. The characteristics of the user's placement of the their body, the ball, and how close the shot came to the target is preferably indicated on a score card or training sheet with columns and rows as shown in FIG. 10.

The training sheet of FIG. 10 has columns for indicating the left and right foot position 272, 274, distance of the ball from the feet 276, left and right toe alignment 278, 280, ball placement 282, and whether the shot resulted in being near the target 284. The user's left and right foot position corresponds to the second set of foot placement lines 207. The toe alignment of the left and right foot corresponds to the first set of foot placement lines 204. The distance of the ball from the feet is measured using the ball distance placement lines 262. The ball placement corresponds to where the ball is placed relative to ball alignment lines 248, 250. Based on the final resting position of the ball from the three shots relative to the target of choice, the ball may be moved left or right and the feet may be adjusted to turn the golfer's body, the distance of the user's feet from the ball, and the angle of the user's feet may all be altered to adjust the direction of the ball.

When the user has found a combination of left and right foot position 272, 274, distance of the ball from the feet 276, left and right toe alignment 278, 280, ball placement 282 that results in the ball being near the target chosen, the numbers are recorded on a master sheet as shown in FIG. 11. The master sheet has columns for club type 286, the left and right foot position 272, 274, distance of the ball from the feet 276, left and right toe alignment 278, 280, ball placement 282, and any notes 288.

For example, if a user had taken four or five shots with the placement of the feet, alignment of the toes and heels, distance of the ball from the feet, and ball placement as shown in FIG. 10, the user or another individual would be able to analyze the shots taken and determine that the user hits the target when their left foot position is 11, the right foot position is 12, the distance to the ball is between 15 to 16 inches from the feet, and toes of the left and right foot are aligned with 7, and the ball is placed at 3. By realigning the user to these specific ball and body placements, the user can hit the ball to the target for repeated shots. When the user finds the combination that works best, from the shots taken and recorded on the training sheet shown in FIG. 10, the user or another individual would record the final placement of the left toe, right toe, left foot placement, right foot placement, ball position, and distance of the ball from feet in a master sheet as shown in FIG. 11. In this example and based on the recorded shots shown in FIG. 10, the following is recorded in the master sheet, the left foot position is 11, the right foot position is 12, the distance to the ball is 15 inches from the feet, and toes of the left and right foot are aligned with 7, and the ball is placed at 3.

The heels may be aligned with the foot placement lines 204 instead of the toes of the user.

Figure 12:
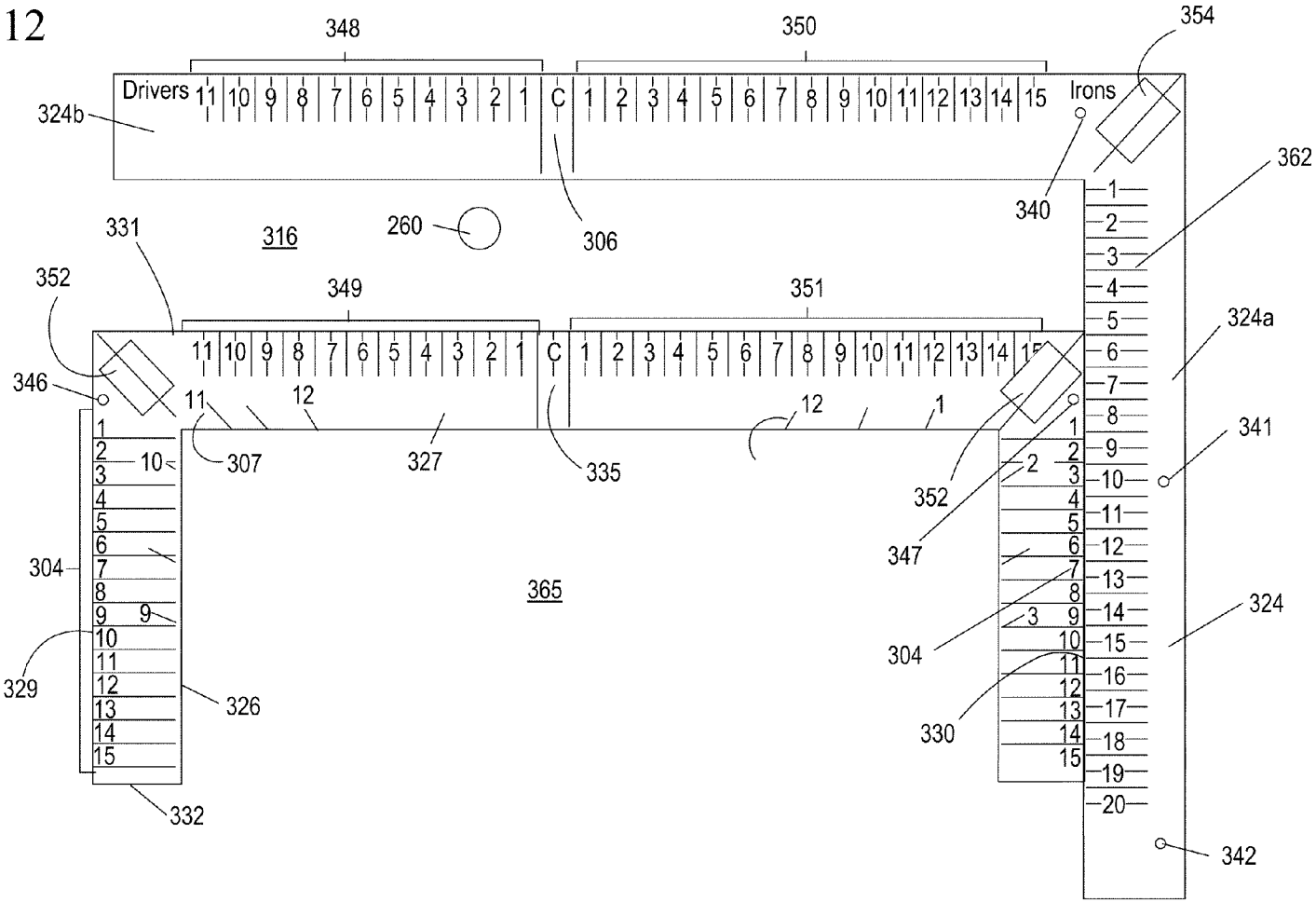
FIG. 12 shows a top view of a fifth embodiment of the training plate.
Figure 13:
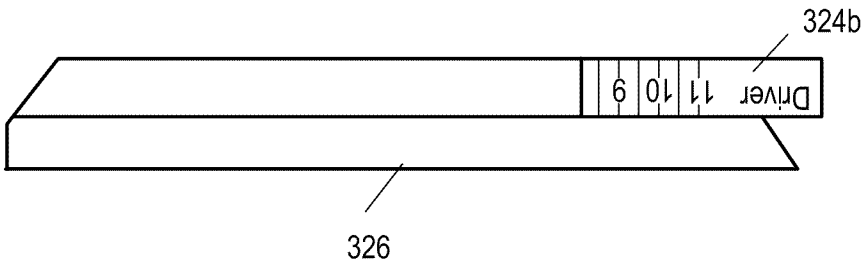
FIG. 13 shows a top view of a fifth embodiment of the training plate folded for transport.

FIGS. 12-13 show a training plate 303 of a fifth embodiment that may be used for all clubs including drivers and short irons for designating proper alignment, body position, and swing path of the golf club. The training plate 303, like the training plate of the fourth embodiment shows alignment and references for the ball, feet and body position for each club and each shot taken. Shots preferably range from 50 to 300 yards. The main differences between the training plate of the fourth embodiment and the fifth embodiment, is that the training plate 303 of the fifth embodiment does not divide the foot placement space into two discrete foot placement cutouts in which the user's feet are placed and that the training plate 303 of the fifth embodiment has hinges 352, 354 to allow for easy fold up and transportation of the training plate as shown in FIG. 13.

The training plate 303 includes a generally rectangular body 326 and an L-shaped alignment arm 324. The body 326 has a top surface 327, a bottom surface (not shown), a left side 329, a right side 330, a forward side 331, and a rear side 332. Holes 346 and 347 may be present on the body to secure the body 326 to the ground using golf tees or stakes if desired. Hinges 352 are preferably present between the left side 329 and the forward side 331 of the body 326 and the right side 330 and the forward side 331 of the body 326, to allow for easy fold up and transport as shown in FIG. 13.

The alignment arm 324 is preferably slidably connected to the side 330 of the body 326, preferably through a tongue and groove arrangement (not shown), although the alignment arm may also just be placed next to the left side 329 or right side 330 of the body 326. The alignment arm 324 is preferably L-shaped, having a short portion 324*a* and a long portion 324*b*, with the longer portion 324*b* of the "L" being substantially parallel to the forward side 331 of the body 326. A series of holes 340, 341, and 342 are present along the short portion 324*a* of the alignment arm 324 and may used with golf tees or some other type of stake to secure the alignment arm to the ground.

When the training plate is laid flat and in training position, as shown in FIG. 12, a training space 316 is defined between the long portion 324*b* of the alignment arm 324, the short portion 324*a* of the alignment arm 324, and the forward side 331 of the body 326. When the training plate is used by a user, at least one golf ball 260 is placed within the training space 316.

The body 326 defines a foot placement space 305 that extends from the rear side 332 of the body and approach the forward side 331 of the body 326. The top surface 327 of the body 326 preferably has a series of foot placement lines 304, 307 adjacent to the foot placement space 305 to aid the user with proper feet placement. The first set of numbered foot placement lines 304 run parallel to the short portion 324*a* of the alignment arm 324 and in this example are numbered 1 to 15. The first set of foot placement lines 304 indicate where the toes of the users would be when their feet are in the foot placement space 305. Alternatively, the heels of the users may also be used to indicate where the feet of the users are relative to the foot placement space 305. The second set of foot placement lines 307 are present around the foot placement space 305 and indicate the angle in which the toe of the user would be pointing. In this example, the numbers of the second set of foot placement 307 lines are 9 to 12 and 12 to 3 and preferably correspond to positions on a clock.

The top surface 327 of the body 326 also includes ball alignment lines 349 and 351 which correspond with ball alignment lines 348, 350 on the alignment arm 324 which are specific to the type of club being used to take the shot. Between the sets of ball alignment lines specific to club type is preferably a center line C 335. The ball alignment lines 349, 351 are comprised of a series of parallel lines which are aligned with the series of ball alignment lines 348, 350 on the alignment arm. The ball alignment lines on the top surface 327 of the body 326 are indicated by 1 to 11 and are for ball placement within the training space 316 for drivers and woods. The ball alignment lines for ball placement within the training space 316 for irons are indicated by 1 to 15. In one embodiment, the ball alignment lines 351 may be indicated in a different color than ball alignment lines 349.

The long portion 324*b* of the alignment arm 324 has ball alignment lines 348, 350 that are specific to the type of club being used to take the shot. The ball alignment lines 348, 350 are comprised of a series of parallel lines which are aligned with the ball alignment lines 349, 351 on the top surface of the body 326. The ball alignment lines 348 present on the long portion 324*b* of the L-shaped alignment arm 324 are indicated by 1 to 11 and are for ball placement within the training space 316 for using drivers and woods. The center line C 306 is present between the two sets of ball alignment lines 348 and 350.

The ball alignment lines 350 present on the long portion 324*b* of the L-shaped alignment arm 324 are indicated by 1 to 15. In one embodiment, the ball alignment lines 350 for ball placement within the training space 316 for irons may be further distinguished from the ball alignment lines for drivers and woods by a change in color.

The short portion 324*a* of the L-shaped alignment arm 324 has ball distance placement lines 362 that are preferably numbered 1 to 20 indicating the number of inches of the back of the feet to the ball placed within the training space 316.

The training plate 303 of the fifth embodiment may be used to correct a user's swing for all clubs including woods and drivers and irons for designating proper alignment, body position, and swing path of the golf club. To correct a user's swing, a user places the training plate 303 a specific distance away from the hole, target, or other chosen marker. The user may or may not use a tee or other stake to secure the training plate to the ground using holes 340, 341, 342, 346, 347. A user than steps into the foot placement space 305 and aligns their toes with the first set of foot placement lines 304 and adjusts the angle of their feet with the second set of foot placement lines 307. Then the user aligns the golf ball 260 in the training space 316 created between the long portion 324*b* of the alignment arm 324, the short portion 324*a* of the alignment arm 324, and the forward side 331 of the body. The user hits at least three shots to a target of choice which is preferably approximately 150 yards away. For each shot hit by the user, the user or another individual marks or keeps track of the left and right foot position, distance of the ball from the feet, left and right toe alignment, ball placement, and whether the shot resulted in being near the target. The characteristics of the user's placement of the their body, the ball, and how close the shot came to the target is preferably indicated on a score card or training sheet with columns and rows as shown in FIG. 10.

The training sheet of FIG. 10 has columns for indicating the left and right foot position 272, 274, distance of the ball from the feet 276, left and right toe alignment 278, 280, ball placement 282, and whether the shot resulted in being near the target 284. The user's left and right foot position corresponds to the second set of foot placement lines 307. The toe alignment of the left and right foot corresponds to the first set of foot placement lines 304. The distance of the ball from the feet is measured using the ball distance placement lines 362. The ball placement corresponds to where the ball is placed relative to ball alignment lines 348, 349, 350, 351. Based on the final resting position of the ball from the three shots relative to the target of choice, the ball may be moved left or right and the feet may be adjusted to turn the golfer's body, the distance of the user's feet from the ball, and the angle of the user's feet may all be altered to adjust the direction of the ball.

When the user has found a combination of left and right foot position 272, 274, distance of the ball from the feet 276, left and right toe alignment 278, 280, ball placement 282 that results in the ball being near the target chosen, the numbers are recorded on a master sheet as shown in FIG. 11. The master sheet has columns for club type 286, the left and right foot position 272, 274, distance of the ball from the feet 276, left and right toe alignment 278, 280, ball placement 282, and any notes 288.

For example, if a user had taken four or five shots with the placement of the feet, alignment of the toes and heels, distance of the ball from the feet, and ball placement as shown in FIG. 10, the user or another individual would be able to analyze the shots taken and determine that the user hits the target when their left foot position is 11, the right foot position is 12, the distance to the ball is between 15 to 16 inches from the feet, and toes of the left and right foot are aligned with 7, and the ball is placed at 3. By realigning the user to these specific ball and body placements, the user can hit the ball to the target for repeated shots. When the user finds the combination that works best, from the shots taken and recorded on the training sheet shown in FIG. 10, the user or another individual would record the final placement of the left toe, right toe, left foot placement, right foot placement, ball position, and distance of the ball from feet in a master sheet as shown in FIG. 11. In this example and based on the recorded shots shown in FIG. 10, the following is recorded in the master sheet, the left foot position is 11, the right foot position is 12, the distance to the ball is 15 inches from the feet, and toes of the left and right foot are aligned with 7, and the ball is placed at 3.

In all of the embodiments, the training plates are preferably made of a carbon polymer material.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A golf training plate comprising:

a rectangular body comprising:

a top surface, a left side, a right side, a forward side, a rear side having a foot placement space extending from the rear side of the body towards the forward side of the body and further defined by the left side and right side of the body, a first set of foot placement lines adjacent to the foot placement space, a second set of foot placement lines located between the rear side and the forward side of the foot placement space and on the forward side of the foot placement space, and a plurality of parallel ball alignment lines on the top surface of the body, spaced apart a distance, with at least one of the ball alignment lines located along a center line between the left side and right side of the body and perpendicular to the forward side of the body; and an L-shaped alignment arm comprising:

a short portion adjacent the right side of the body, having a series of ball distance placement lines, a long portion, substantially parallel to the forward side of the body, defining a training space for placement of a ball, and a series of parallel ball alignment lines for different types of golf clubs aligned with the parallel ball alignment lines on the top surface of the body, at least one of the ball alignment lines of the alignment arm being located along a center line of the long portion of the alignment arm.

2. The training plate of claim 1, further comprising a training sheet.

3. The golf training plate of claim 1, wherein the a foot placement space is further divided into two foot placement cutouts.

4. A method of training and correcting a golf swing for woods, drivers, and irons using a golf training plate comprising a rectangular body comprising: a top surface, a left side, a right side, a forward side, and a rear side; a foot placement space extending from the rear side towards the forward side and further defined by the left side and right side of the body, a first set of foot placement lines adjacent to the foot placement space, a second set of foot placement lines located between the rear side and the forward side of the foot placement space and on the forward side of the foot placement space, and a plurality of parallel ball alignment lines on the top surface of the body, with at least one of the ball alignment lines located along a center line between the left side and right side of the body and perpendicular to the forward side of the body; and an L-shaped alignment arm comprising: a short portion adjacent the right side of the body, having a series of ball distance placement lines, a long portion, substantially parallel to the forward side of the body, defining a training space for placement of a ball, and a series of parallel ball alignment lines for different types of golf clubs aligned with the parallel ball alignment lines on the top surface of the body, at least one of the ball alignment lines of the alignment arm being located along a center line of the long portion of the alignment arm comprising the steps of:

placing the golf training plate a distance away from a target;

aligning toes of a user with the first set of foot placement lines adjacent the foot placement space of the golf training plate;

adjusting the angle of the toes of the user with the second set of foot placement lines around the foot placement space;

aligning a golf ball within the training space;

swinging the golf club and hitting the ball towards the target;

recording the left foot placement, right foot placement, distance of the ball from the feet of the user, left toe alignment, right toe alignment, and ball placement relative to the a center line of the alignment arm of the user, and whether the ball comes near or in contact with the target for each golf swing taken;

adjusting the left foot placement, right foot placement, distance of the ball from the feet of the user, left toe alignment, right toe alignment, and ball placement relative to the a center line of the alignment arm of the user based on whether the ball comes near or in contact with the target for each golf swing taken.

* * * * *